US008322413B2

(12) United States Patent
Bishop et al.

(10) Patent No.: US 8,322,413 B2
(45) Date of Patent: Dec. 4, 2012

(54) TWIN LATCH WIRELINE RETRIEVAL TOOL

(75) Inventors: David S. Bishop, Houston, TX (US); Dennis E. Kroll, League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 249 days.

(21) Appl. No.: 12/857,962

(22) Filed: Aug. 17, 2010

(65) Prior Publication Data

US 2012/0043073 A1 Feb. 23, 2012

(51) Int. Cl.
*E21B 31/107* (2006.01)

(52) U.S. Cl. ..... 166/98; 166/178

(58) Field of Classification Search ..... 166/98, 166/99, 114, 178
See application file for complete search history.

(56) References Cited

U.S. PATENT DOCUMENTS

| | | | | |
|---|---|---|---|---|
| 3,667,543 | A | 6/1972 | Dean | |
| 3,714,983 | A | 2/1973 | Wilson | |
| 4,044,826 | A | 8/1977 | Crowe | |
| 4,332,410 | A | 6/1982 | Baker | |
| 4,805,699 | A | 2/1989 | Halbardier | |
| 4,869,325 | A | 9/1989 | Halbardier | |
| 5,366,012 | A | 11/1994 | Lohbeck | |
| 6,220,348 | B1 | 4/2001 | Serafin et al. | |
| 6,224,642 | B1 | 5/2001 | Daly et al. | |
| 6,681,858 | B2 | 1/2004 | Streater | |
| 7,036,602 | B2 | 5/2006 | Turley et al. | |
| 7,389,823 | B2 | 6/2008 | Turley et al. | |
| 2006/0272828 | A1 * | 12/2006 | Manson | 166/387 |
| 2009/0000792 | A1 | 1/2009 | Turley et al. | |
| 2011/0036564 | A1 * | 2/2011 | Williamson | 166/188 |

* cited by examiner

*Primary Examiner* — William P Neuder
(74) *Attorney, Agent, or Firm* — Steve Rosenblatt

(57) ABSTRACT

The retrieving tool engages an equalizing sleeve on a jar down movement while the packer or bridge plug release sleeve is held fixed with a locking dog. The initial jarring down allows the tool to engage the equalizing sleeve and pull it up subsequent to the initial engagement by jarring down. Pulling or jarring up then opens the equalizing ports while still holding the release sleeve locked using a trapped collet. A subsequent jarring down allows engagement of a second sleeve so that a subsequent pulling or jarring up moves the second sleeve away from the collet that had otherwise held the set position of the packer or bridge plug. A pull or jar force up brings up the now released packer or bridge plug.

20 Claims, 2 Drawing Sheets

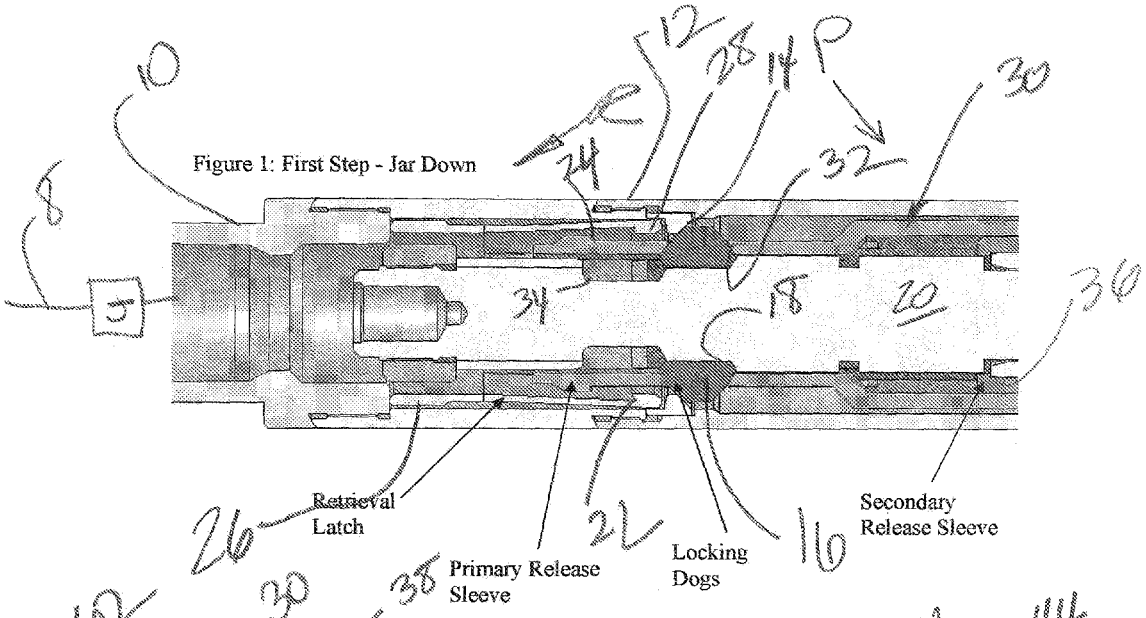
Figure 1: First Step - Jar Down
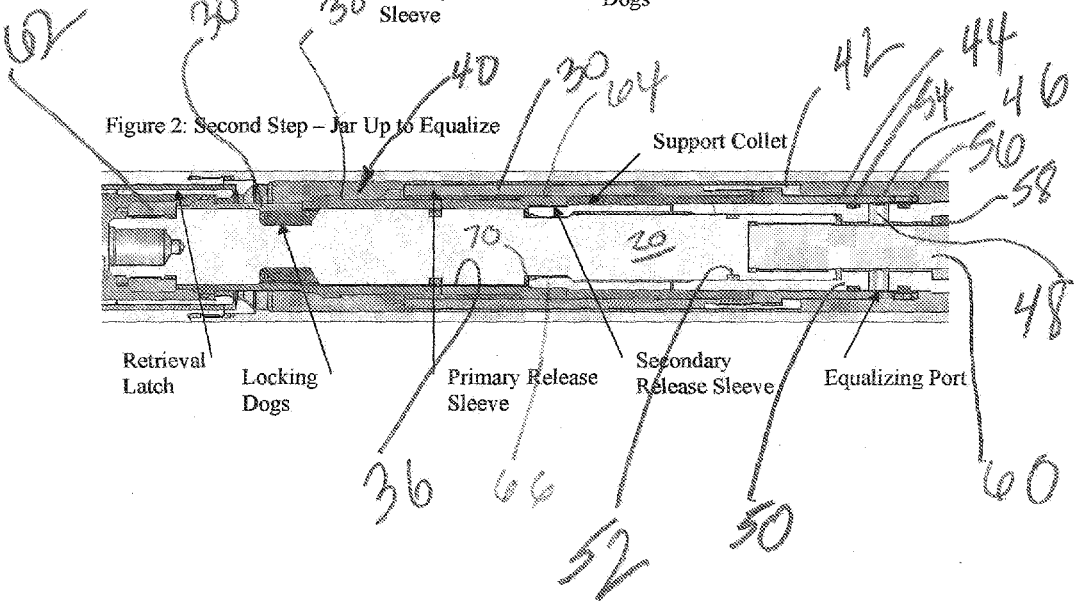
Figure 2: Second Step – Jar Up to Equalize Figure 3: Third Step - Jar Down
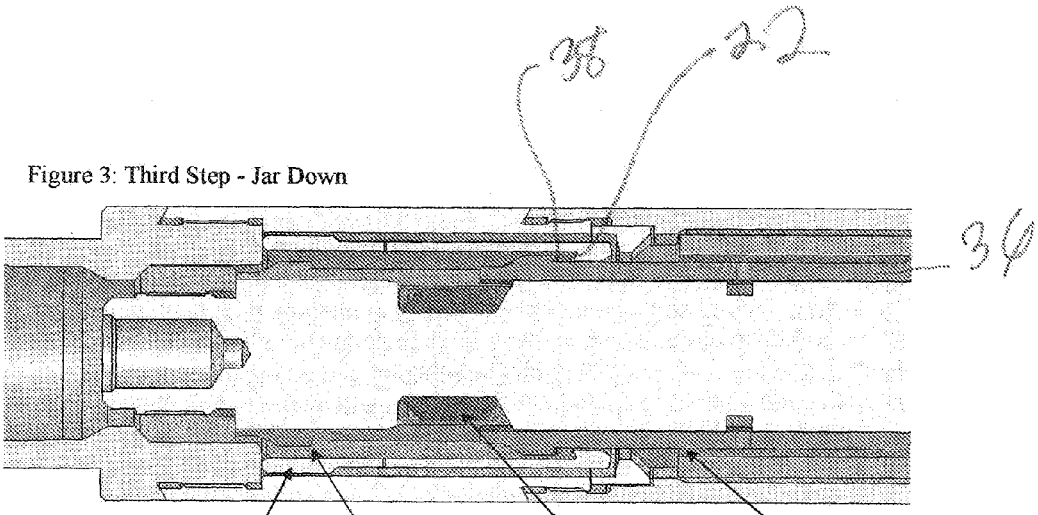
Figure 4: Fourth Step – Jar Up to Retrieve
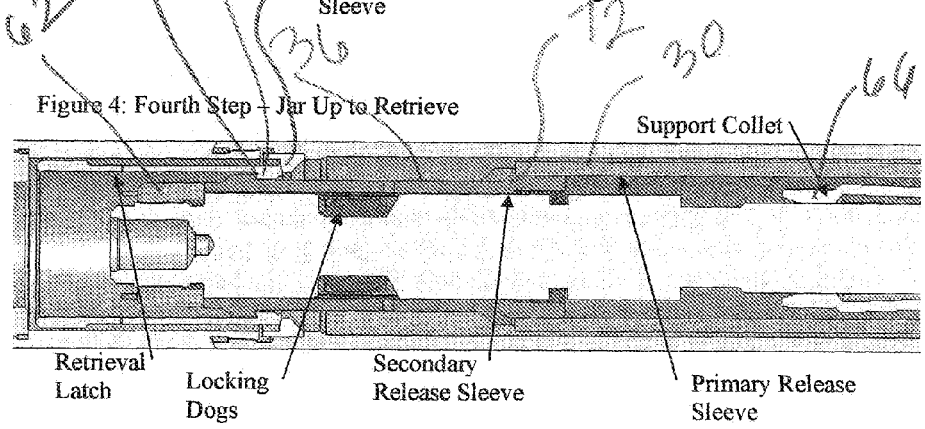

TWIN LATCH WIRELINE RETRIEVAL TOOL

FIELD OF THE INVENTION

The field of the invention is retrieval tools run on wireline that perform the retrieval in distinct operations using cyclical movements to separate the functions for sequential operation.

BACKGROUND OF THE INVENTION

Packers and bridge plugs are used to isolate zones in a subterranean location. Retrievable versions of such devices need to be released from sealing and mechanical grips that their components have on the surrounding wellbore. Different types of tools have been developed for such retrieval operations. Some are tubing run and others are delivered on wireline. Generally these tools need to grip and undermine the slips and sealing element that had earlier been set, most likely by compressive forces based on hydraulic pressure or setting down weight, for example.

The set isolation devices can have large pressure differentials acting on them and it is desirable to equalize pressure across such barrier devices before the slips and sealing elements are allowed to relax. Prior designs that have actually employed an equalizing pressure feature before release have done so in one continuous motion where it was hoped that the equalization had sufficiently taken place before the mechanical release. However, since both movements were supposed to be accomplished in the same unidirectional movement, there was a risk that the equalization had not sufficiently taken place by the time the mechanical release took place. If that happened the packer or plug could be propelled and get stuck at another location in the wellbore. If the retrieval tool was run in on tubing, the tubing could be bent and contorted as the packer or bridge plug that had not been fully equalized was propelled uphole upon mechanical release.

Some retrieval tool designs just grabbed the packer or bridge plug and mechanically released it without concern of differential pressure that may be acting on it at the time. Tools using a single jarring motion to release either with or without equalizing and run on wireline or tubing include: US Publication 2009/0000792; U.S. Pat. Nos. 7,036,602; 7,389,823; 4,805,699 (coiled tubing); 4,869,325 (coiled tubing); 6,220,348 (equalize and pull retrieval lugs); 6,244,642 (equalize and pull on retrieval lugs); 5,366,012 (jar and release); 3,714,983 (jar to equalize and release in same motion); 4,044,826 (jar and release); 3,667,543 (jar and operate a j-slot); 6,681,858 (tubing conveyed grapple) and 4,332,410 (release tool jars to break free of stuck packer).

What is needed in a retrieving tool and provided by the present invention is a way to be sure that the operation of equalizing a packer or bridge plug is done at a time and in a way that cannot release the slips and sealing element. More particularly the equalization and subsequent release for retrieval are accomplished with jar movements and intervening pickup force. The equalizing releases a locking dog on a second sleeve whose movement then becomes possible to release the packer or bridge plug and retrieve it. These and other features of the present invention will become more apparent to those skilled in the art from a review of the description of the preferred embodiment and the associated drawings while recognizing that the full scope of the invention is to be determined from the literal and equivalent scope of the appended claims.

SUMMARY OF THE INVENTION

The retrieving tool engages an equalizing sleeve on a jar down movement while the packer or bridge plug release sleeve is held fixed with a locking dog. The initial jarring down allows the tool to engage the equalizing sleeve and pull it up subsequent to the initial engagement by jarring down. Pulling or jarring up then opens the equalizing ports while still holding the release sleeve locked using a trapped collet. A subsequent jarring down allows engagement of a second sleeve so that a subsequent pulling or jarring up moves the second sleeve away from the collet that had otherwise held the set position of the packer or bridge plug. A pull or jar force up brings up the now released packer or bridge plug.

BRIEF DESCRIPTION OF THE DRAWINGS

FIG. 1 is a section view of the retrieval tool jarred down onto the packer or bridge plug to engage its pressure equalizing sleeve;

FIG. 2 is the view of FIG. 1 showing the equalizing sleeve jarred up to equalize pressure across the packer or bridge plug and the locking dogs retracted in a groove;

FIG. 3 is the view of FIG. 2 showing another jar down to engage the release sleeve for the packer or bridge plug; and FIG. 4 is the view of FIG. 3 with an upward force applied to retrieve the packer or bridge plug.

DETAILED DESCRIPTION OF THE PREFERRED EMBODIMENT

The retrieval tool R is brought to the packer or bridge plug P in FIG. 1. The retrieval tool R has a top sub 10 secured to a jar or jars J above top sub 10 and are of a type well known in the art. The assembly is preferably supported on a wireline 8 but can be alternatively supported by coiled or rigid tubing. A multi-component housing 12 has a landing shoulder 14 that engages the dogs 16 when the initial jarring don takes place as shown in FIG. 1. The dogs 16 shoulder on surface 18 of mandrel component 20 of the plug P. The jarring down motion gets the surface 22 past surface 24 so that as a result of a subsequent pickup force those two surfaces will engage as shown in FIG. 2. Surface 22 is on a retrieval latch 26 which is a series of collet fingers with heads 28 at their lower ends and the surface 22 is on the heads and internal to the fingers that support the heads 28. The surface 24 is a part of a primary release sleeve 30 that is best seen in FIG. 2. In FIG. 1 an opening 32 allows the dogs 16 to extend through so that the shoulder 14 can land on the dogs 16 when the first down jarring movement occurs for the tool R.

The dogs 16 are disposed initially below the recess 34 in mandrel component 20. The primary release sleeve 30 overlays the secondary release sleeve 36 in a manner that lets surface 38 of the secondary release sleeve protrude through a window 40 in the primary release sleeve 30. As seen in FIG. 2 the primary release sleeve 30 has a bottom sub 42 that traps the equalizing sleeve 44 for tandem movement with sleeve 30. The equalizing sleeve has a port 46 that in FIG. 1 is misaligned with port 48 on the support collet assembly 50. Seal 52 seals between the mandrel component 20 and the collet assembly 50. Seals 54 and 56 are on the collet assembly 50 and straddling the port 48. Initially but not shown in the FIG. 1 the equalizing sleeve 44 has its port 46 offset from port 48 to keep the ports 48 closed. Passage 58 extends from below the set packer or bridge plug P and around the mandrel 60. In the FIG. 1 position the pressure from below the plug P is trapped in passage 58 by sleeve 44 and seals 52, 54 and 56.

In the FIG. 1 position the surface 38 is beyond the reach of the latch 26. Latch 26 with a jar down force applied to it gets surface 22 below surface 24 so that a subsequent jarring up force engages surface 22 to surface 24 to pull up sleeve 30 with dogs 16 until dogs 16 fall into recess 34 and sleeve 30 hits a travel stop 62. Once sleeve 30 hits the travel stop 62, the latch 26 releases sleeve 30 automatically. The release sleeve 36 cannot be accessed at this time because the dogs 16 supported on surface 18 stop the shoulder 14 and the collet heads 28 well above the release sleeve 36. The subsequent jarring up puts the dogs 16 into groove 34 to allow the primary release sleeve 30 to advance to travel stop 62 while taking sleeve 44 with primary release sleeve 30 so as to open ports 48 to equalize the plug P. These movements occur without moving the secondary release sleeve 36 that still has its lower end 64 trapping collet heads 66 of the support collet 68 trapped to groove 70 to continue to hold the set of the plug P.

Now referring to FIG. 3, it can be seen that with the dogs 16 in groove 34, that jarring down will get the surface 22 of collet heads 28 below surface 38 on the upper end of the secondary release sleeve 36. A subsequent jarring up force will move the secondary release sleeve 36 away from trapping collet heads 66 to groove 70 and make it move relatively to sleeve 30 until the secondary release sleeve 36 and sleeve 30 engage the travel stop 62 as shown in FIG. 4. The upper end of sleeve 36 with the radial surfaces 38 is a finger structure that has fingers aligned with gaps in sleeve 30 so that both sleeves 30 and 36 can wind up against travel stop 62 at their respective upper ends, as shown in FIG. 4. As soon as sleeve 36 moves away from collet heads 66 the plug P is released so that it can be retrieved with the retrieving tool R by virtue of the engaged surfaces 38 and 22 wedged together by the surface 14 on the retrieval tool R.

Those skilled in the art will appreciate the presence of the dogs 16 in there supported position prevents the tool R from reaching the secondary sleeve 36 in the initial jarring down. This insures that the equalizing sleeve 44 will be operated first as the primary release sleeve 30 is initially operated to move relatively to the secondary sleeve 36. This relative motion allows the dogs to retract into groove 34 as the sleeve 30 is pulled to its travel stop 62. Now the plug P is equalized but still held firm in the wellbore. A subsequent jarring down now allows the secondary sleeve 36 to be engaged and pulled up until the collet heads 66 are no longer trapped to groove 70. As soon as that happens, the trapped compressive force in the sealing element of the plug P extends as the collet heads 66 no longer retain the sealing element of the plug P in the compressed condition. As a result the collet heads 66 jump out of the groove 70 as shown in FIG. 4. The jar up force takes up the plug P as the surfaces 22 and 38 are held together by having the weight of the plug P trapping them in that relationship against surface 14 of the retrieval tool R.

Those skilled in the art will appreciate that a single jarring direction of the retrieval tool R when connected to the plug P will equalize the plug P without actually releasing it. The release sleeve for the plug P only becomes accessible when the equalizing has been accomplished by the initial jarring up force. It takes a second jarring down and jarring up to engage the plug release sleeve 36 so that the assembly of the retrieving tool R and the plug P can be pulled to the surface. While the equalizing and release in the preferred embodiment is done with sleeves other mechanisms that ensure sequential operation of equalizing before release of the plug are within the scope of the present invention. This is preferably accomplished by blocking access to operating the release mechanism until the equalizing mechanism is operated. More specifically a cycle of jarring down and up takes place before the release can happen in an independent cycle of jarring down and up a second time. Reference to jarring up can also be accomplished by a simple pull on the wireline even without actuation of the attached jar tool. While it is preferred to deliver the retrieval tool R on wireline as an alternative coiled or rigid tubing can be used without departing from the invention.

The above description is illustrative of the preferred embodiment and many modifications may be made by those skilled in the art without departing from the invention whose scope is to be determined from the literal and equivalent scope of the claims below.

We claim:

1. A retrieval tool in combination with mechanisms for equalizing and releasing a barrier tool from a set position in a subterranean location wherein said barrier tool is isolating a portion of a wellbore and for subsequent removal of said barrier tool to a surface location, said barrier tool comprising a seal and a grip device that are released to enable removal of said barrier tool, the improvement comprising:

a first mechanism for selectively equalizing pressure across said seal device when said seal device is against a wall of a subterranean passage and a discrete second mechanism for releasing said seal and grip devices from the wall;

the retrieval tool selectively engageable to said mechanisms to operate said mechanisms in a predetermined order.

2. The combination of claim 1, wherein:

said mechanisms can only be operated in a single order.

3. The combination of claim 2, wherein:

said first mechanism has to be operated before said second mechanism can be operated.

4. The combination of claim 3, wherein:

said second mechanism is selectively blocked by a barrier that is defeated by movement of said first mechanism.

5. The combination of claim 4, wherein:

said barrier comprises at least one dog that in a supported position off a mandrel of said barrier tool limits advance of said retrieving tool to a location short of said second mechanism.

6. The combination of claim 5, wherein:

said retrieving tool comprising a retrieving latch that is positioned to grip said first mechanism after the progress of said retrieving tool over said mandrel is stopped by said dog.

7. The combination of claim 6, wherein:

said retrieving tool comprises a jar to initially advance the retrieving latch in a first direction to engage said dog.

8. The combination of claim 7, wherein:

said retrieving latch is selectively moved in a second direction opposite said earlier movement in said first direction by said jar to align said dog with a mandrel groove, thereby allowing a subsequent movement of said retrieving latch in said first direction to engage said second mechanism.

9. The combination of claim 8, wherein:

said movement in said second direction to align said dog with said groove actuates said first mechanism to equalize pressure on said barrier tool.

10. The combination of claim 9, wherein:

actuation of said jar in said first direction after operation of said first mechanism to equalize pressure on said barrier tool positions said retrieving latch to engage said second mechanism.

11. The combination of claim 10, wherein:

actuation of said jar in said second direction with said retrieving latch engaged to said second mechanism allows said seal and grip devices to release for retrieval of said barrier tool.

12. The combination of claim 11, wherein:

said second mechanism is moved by said retrieving latch with respect to said first mechanism when allowing said seal and grip devices to release for retrieval of said barrier tool.

13. The combination of claim 3, wherein:

said first mechanism has to translate before any translation of said second mechanism can take place with said retrieving tool.

14. The combination of claim 5, wherein:

said first mechanism comprises a sleeve whose axial movement opens a port to a passage along said mandrel to allow pressure equalization across said seal.

15. The combination of claim 1, wherein:

said first and second mechanisms are moved in the same direction at different times to equalize pressure across said seal and to release said seal and said grip devices.

16. The combination of claim 1, wherein:

said retrieving tool comprises a retrieving latch for sequential engagement of said first and second mechanisms with a jarring force against said barrier tool from a jar tool mounted to said retrieving tool.

17. The combination of claim 16, wherein:

said retrieving tool is supported on a wireline.

18. The combination of claim 1, wherein:

said barrier tool comprises a packer or a bridge plug.

19. The combination of claim 8, wherein:

said retrieving latch releases said first mechanism upon shifting said first mechanism in said second direction against a travel stop on said barrier tool.

20. The combination of claim 19, wherein:

said retrieving latch retains said second mechanism when moving said second mechanism against said travel stop for retrieval of said barrier tool.

* * * * *